United States Patent [19]

Richardson et al.

[11] 4,408,811

[45] Oct. 11, 1983

[54] WALL MOUNTED PAPER TOWEL HANDLING UNIT

[75] Inventors: Frank Richardson, Georgetown; Allan H. Campbell, Burlington, both of Canada

[73] Assignee: Twin-Cee Limited, Georgetown, Canada

[21] Appl. No.: 205,463

[22] Filed: Nov. 10, 1980

[51] Int. Cl.[3] ..... B65H 19/00

[52] U.S. Cl. ..... 312/37; 312/38; 312/39; 312/257 SM; 312/242

[58] Field of Search ..... 312/37, 38, 39, 257 SK, 312/257 SM, 211, 265, 242

[56] References Cited

U.S. PATENT DOCUMENTS

| | | | |
|---|---|---|---|
| 1,568,901 | 1/1926 | Mickey | 312/211 |
| 2,229,596 | 1/1941 | Eilers | 312/257 SM |
| 2,883,254 | 4/1959 | Bacca | 312/242 |
| 2,946,636 | 7/1960 | Penney | 312/39 |
| 3,095,249 | 6/1963 | Albrecht | 312/242 |
| 3,147,051 | 9/1964 | Birr et al. | 312/37 |
| 3,222,112 | 12/1965 | Bahnsen | 312/38 |
| 3,510,055 | 5/1970 | Safford | 312/211 |
| 3,603,519 | 9/1971 | Brown et al. | 312/39 |
| 3,920,297 | 11/1975 | Brandes | 312/217 |
| 4,047,775 | 9/1977 | Wolbrink | 312/211 |
| 4,223,965 | 9/1980 | Palandrani | 312/257 SM |

FOREIGN PATENT DOCUMENTS

| | | | |
|---|---|---|---|
| 109851 | 2/1940 | Australia | 312/38 |
| 888012 | 1/1962 | United Kingdom | 312/39 |

*Primary Examiner*—Victor N. Sakran

[57] ABSTRACT

The present invention provides a tamper resistant paper towel handling unit, for mounting in a wall and comprising a wall box and a forward door which is used to open and close the wall box. The door is provided with a mouth or opening which provides access to the wall box when the door is closed. The wall box and door are adapted to co-operate with one another when the door is closed so as to support against inward collapsing of the door and to block off access to the periphery of the doormouth to resist outward prying of the door.

10 Claims, 16 Drawing Figures

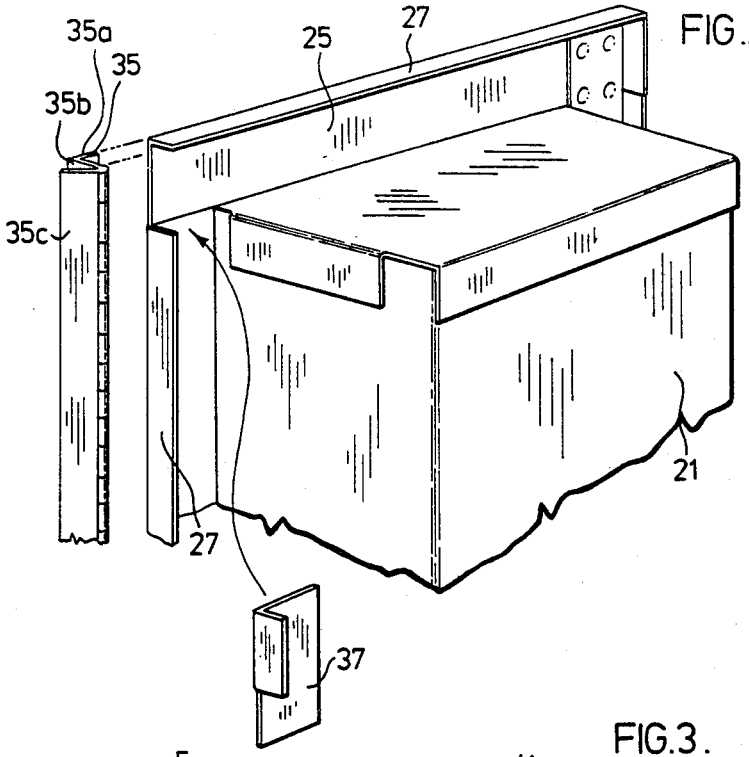
FIG.2.
FIG.3.
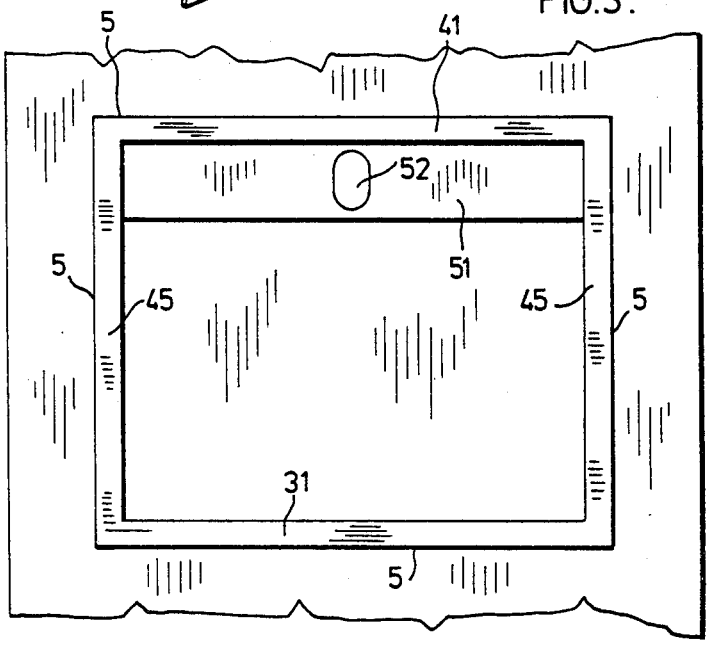

56
57
55
61
48
41
47
39
61
57
53
45
63
53
51
49
50
43
43
33
45
29
25
27
23
31

FIG.10.
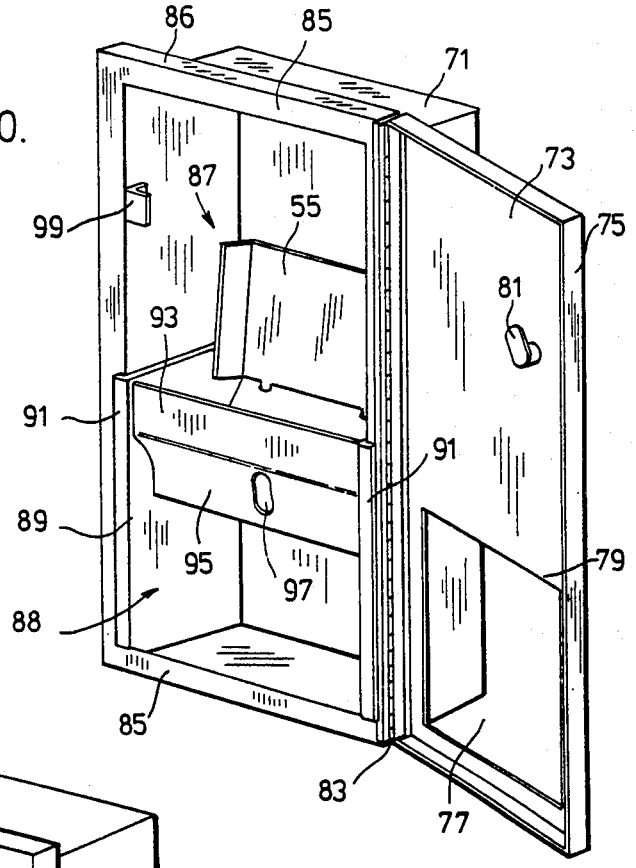
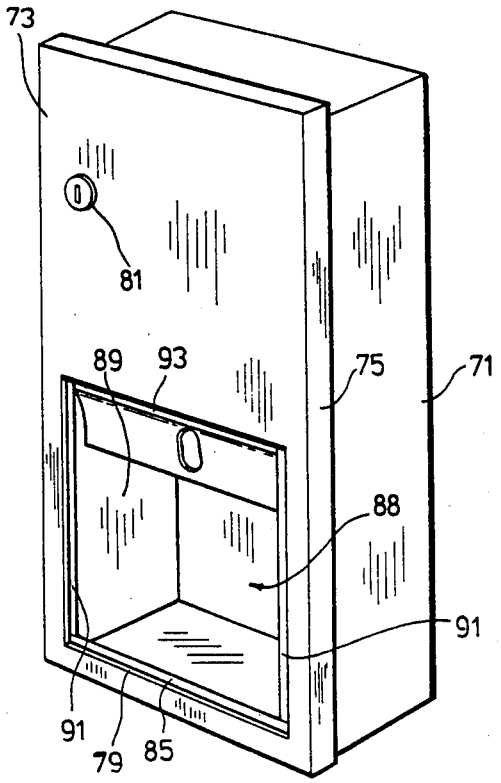
FIG.11.

WALL MOUNTED PAPER TOWEL HANDLING UNIT

FIELD OF THE INVENTION

The present invention relates to a wall mounted paper handling unit having a wall mounted box portion and a forward door for gaining access to the box portion. In particular, the door and box portion are adapted to cooperate with one another in a manner to resist inward collapsing or outward bending of the door when it is closed and locked to the wall box to essentially eliminate tampering and damage to the unit.

BACKGROUND OF THE INVENTION

Most public washrooms are provided with paper towel dispensers and waste receptacles which are generally mounted to a wall in the washroom. In some cases the waste is integral with the towel dispenser, thereby forming a combination unit. The individual as well as the combination units comprise a box portion and a door on the front of the box. This door includes an opening for gaining access to the box when the door is closed. The door can of course, be opened to permit full access to the interior of the box.

For practical and cost purposes, the door is made of thin steel and unfortunately, subject to substantial abuse and damage. It is often the case that the doors on these units which are quite weak due to their thinness, are caved into the box or bent outwardly away from the box. With conventional units, the former problem, i.e. caving in of the door is difficult to avoid because the doors are generally of substantial length and relatively unsupported over their length. The latter problem, i.e., the outward bending of the door is difficult to avoid due to the exposure of the door at both the doormouth and the outer edge of the door.

These units are expensive and the damage which has been caused over the years has been extremely costly in both material and labour replacement costs.

SUMMARY OF THE INVENTION

The present invention provides a tamper resistant paper towel handling unit for wall mounting. The unit comprises a box portion and a door on the box portion with the door having a doormouth for gaining access to the box portion. The box portion is provided with internal reinforcing means which is essentially flush with the door around the doormouth, at its periphery when the door is closed. The reinforcing means is thereby adapted to support the door against inward collapsing and substantially block off the doormouth periphery against outward prying of the door.

The above described arrangement is applicable to both the towel dispensing unit and the waste receptacle unit as well as a combination towel dispenser and waste unit. However, regardless of the unit type involved, the cooperation between the door and the wallbox provides a paper towel handling unit which is much less costly and much easier to maintain than conventional units.

BRIEF DISCUSSION OF THE DRAWINGS

The above as well as other advantages and features of the present invention will be described in greater detail, according to the preferred embodiments of the present invention wherein:

FIG. 1 is a front perspective view looking down on a preferred form of a towel dispenser and waste according to an embodiment of the present invention.

FIGS. 1*a* through 1*c*, show various types of towels dispensed from the unit shown in FIG. 1.

FIG. 2 is a rear perspective view partially broken away of the upper end of the wall box shown in the unit of FIG. 1.

FIG. 3 is an enlarged front plan view of the mouth and towel dispensing region of the unit shown in FIG. 1.

FIGS. 10 and 11 are front perspective views open and closed respectively of a preferred form of a towel dispensing unit according to an embodiment of the present invention.

DETAILED DESCRIPTION OF THE PREFERRED EMBODIMENTS

Figure 1:
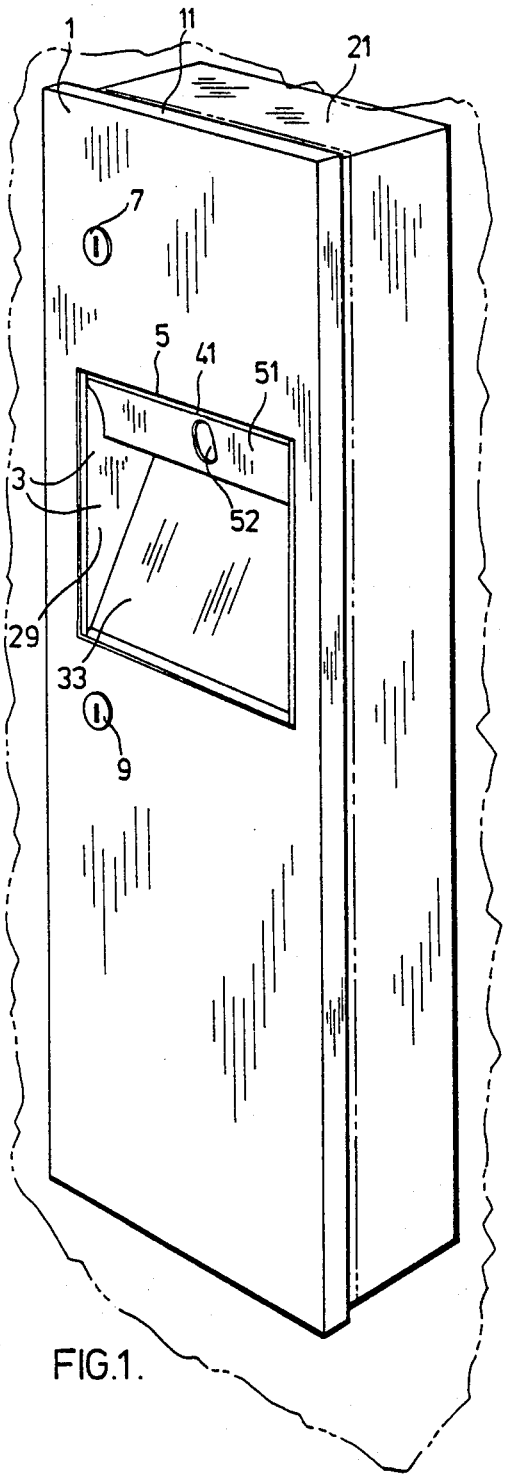

The towel dispenser and waste unit shown in FIG. 1 comprises a forward door 1, and a rearward wall box portion 21. This particular unit is one which is adapted for recessing within a wall rather than surface mounting however, the features which will be described below, are applicable to either type of installation.

The door itself, is provided with a doormouth 3, which when the door is closed, opens into the towel dispensing cavity 29 of the wall box. Located above and below the doormouth are a pair of locking members 7 and 9 which lock the door to the wallbox when the door is closed. The door is further provided with an exterior right angle projecting flange or skirt 11 running around the outer peripheral region of the door.

Figure 4:
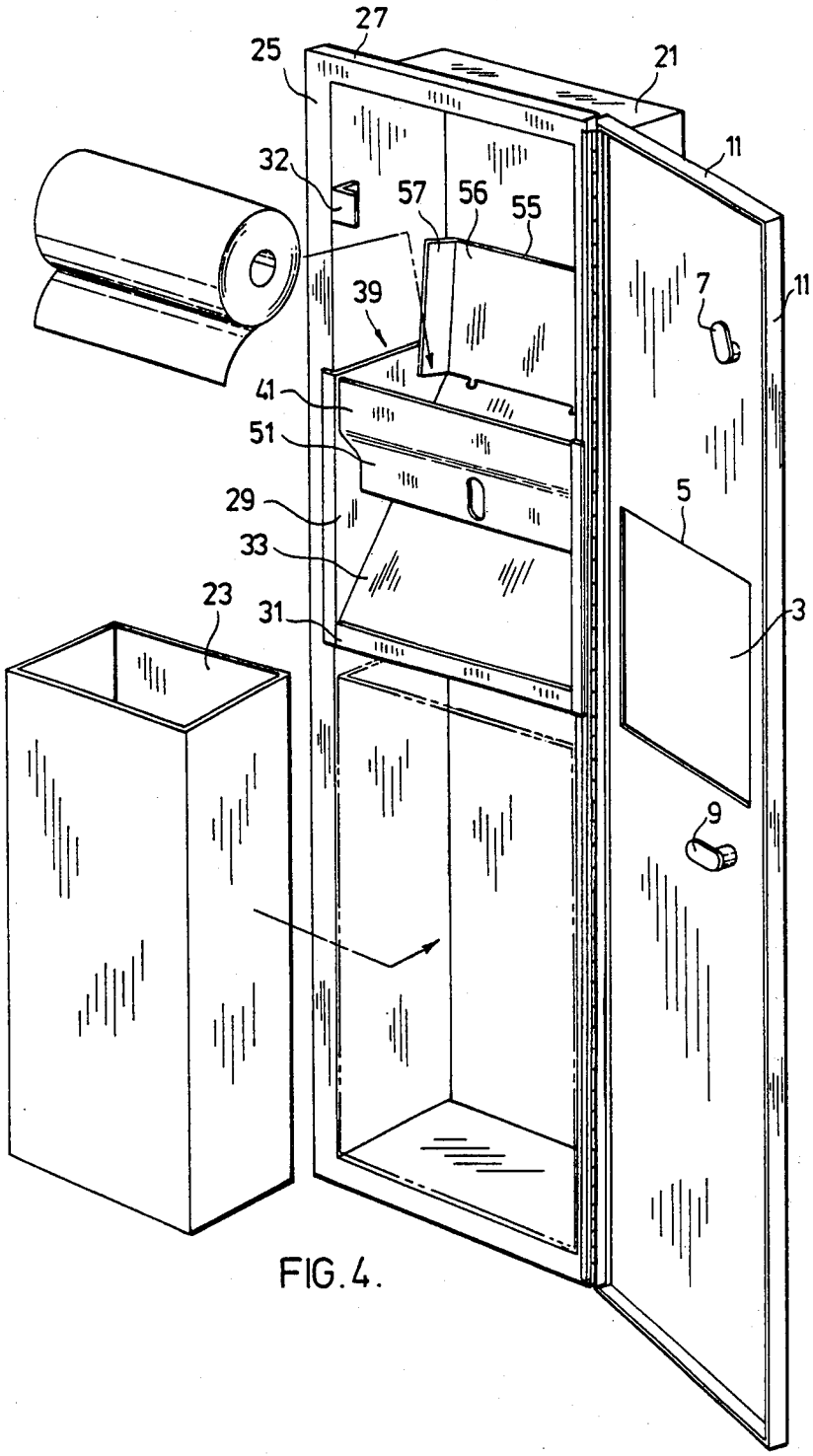
FIG. 4 is a front perspective view of the unit of FIG. 1 with the door opened and the towels and waste bin removed from the unit.

As will be seen in both FIGS. 1 and 4, door 1 is of substantial length which in conjunction with the provision of the access mouth to the towel dispensing cavity substantially weakens the door, which if not properly protected by the box, would be subject to easy inward or outward bending.

The wallbox itself is well shown in FIG. 4. As can be seen here, the box is provided with a substantial lower cavity which is adapted to receive a waste bin 23. Above the dispensing cavity there is provided a towel cradle generally indicated at 39 from which towels are dispensed into cavity 29. This towel cradle is a subassembly which substantially increases the overall strength of the box. As will be explained later in detail, the towel cradle is adaptable to receive and dispense any one of the forms of towels in FIGS. 1*a* through 1*c*.

The wallbox is provided around its periphery with an outwardly projecting flange 25 having a rearwardly projecting portion 27. The box flange is adapted to mate with the outer peripheral region of the door when it is closed to essentially block off any access to the door edge. The box is further provided with a hook member 32 for engaging lock 7 when the door is closed and locked. Lock member 9 engages with brace 31 which has a triple fold function to be described later in detail.

Figure 5:
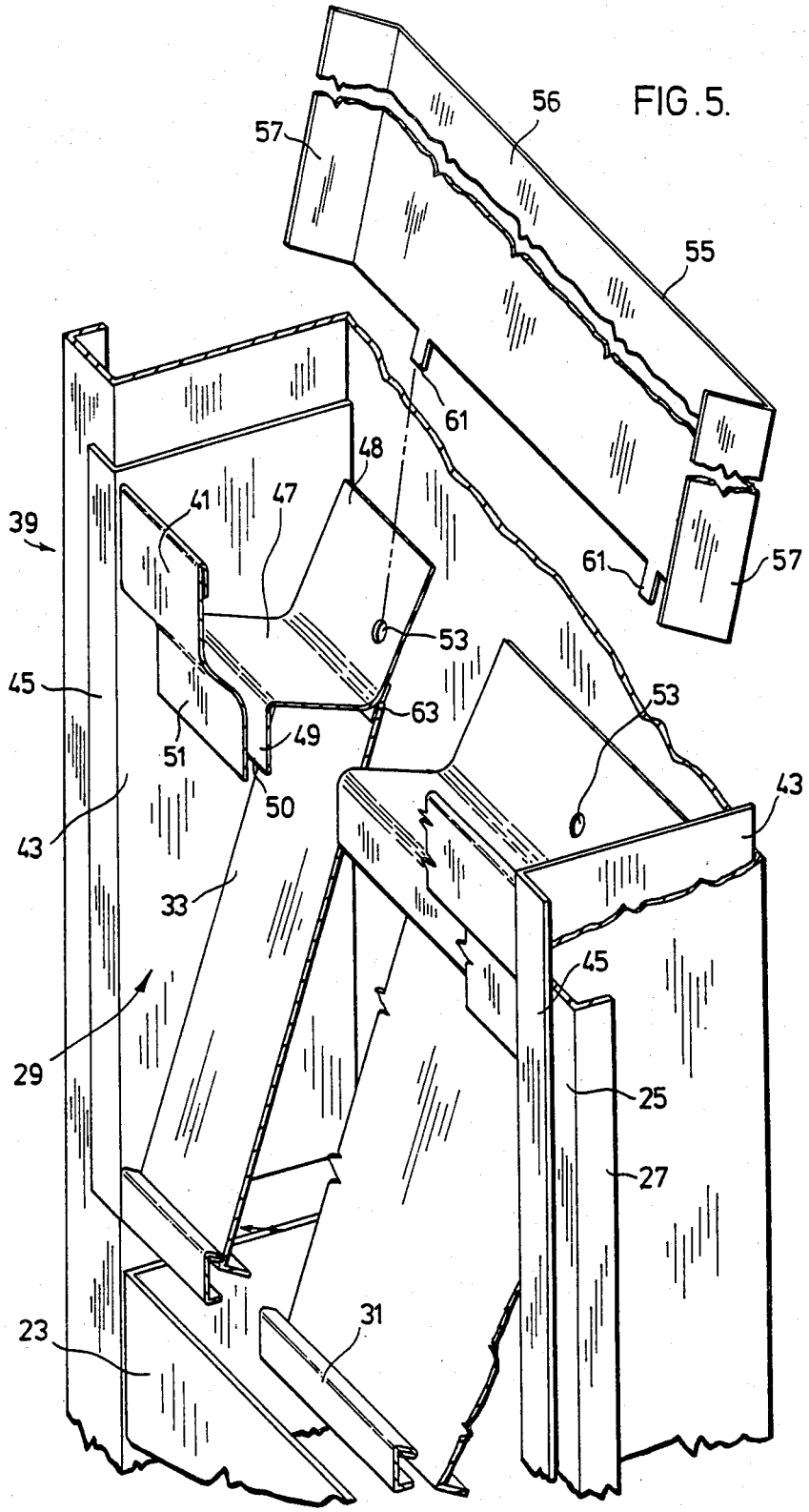
FIG. 5 is a front perspective view looking down on the towel cradle region shown in partial section of the wall box shown in FIG. 4.

The components of the towel cradle 39 subassembly, are best shown in FIG. 5. It includes a housing 43 presenting outwardly extending flange portions 45 wrapping around the inside of the wallbox and over the box flange 25. This housing is used to secure the subassembly in place within the wall box and to integrate the remainder of the components.

The towel cradle subassembly further includes a bottom seat portion 47 on which the bundle or towel roll sits, a backstop portion 48 extending upwardly from the seat 47, and a forward stop portion 41 as well as the brace portion 31 running across the box at about the midpoint. The forward stop portion is positioned such that it is essentially flush with the front of the wallbox, coplanar with the box flange and vertically aligned with brace 31. Front stop 41 curves downwardly and inwardly to a throat portion 51 which cooperates with the lower vertical section 49 of seat 47 in providing a dispensing throat 50 through which the towels are dispensed into cavity 29. When the cradle is used to dispense papers in the towel form, throat portions 49 and 51 are used to provide means for shearing the desired amount of towel from the roll.

Projecting downwardly from the bottom of the towel cradle is a door 33 which separates the towel dispensing cavity from the waste. This door is connected by means of spring hinge 63 to the towel cradle and is biased to the closed position shown in FIG. 5 by the spring hinge. Therefore, the door is normally closed and provides an extremely effective safety feature to trap possible fires within the lower part of the unit.

Figure 1A:
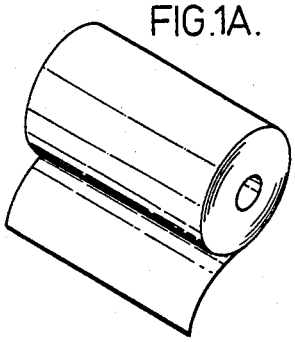
Figure 1B:
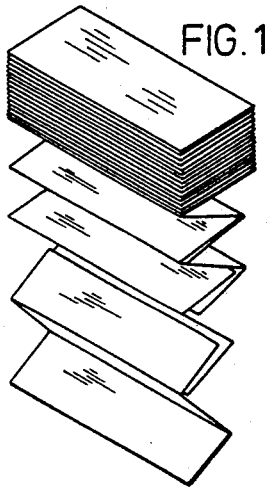
Figure 1C:
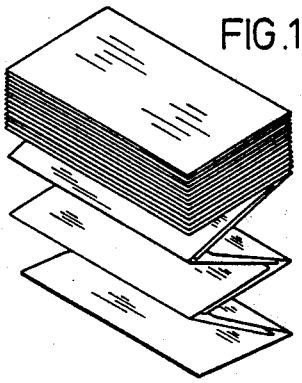

Backstop 48 is provided with a pair of spaced apertures 53 which when needed, are used to receive a pair of prongs 61 of an adapter 55 which adapts the towel cradle for use with the different types of towel arrangements shown in FIGS. 1*a* through 1*c*. The adapter is further provided with a pair of siderails 57 and a rearward towel bundle support 56.

Figure 6:
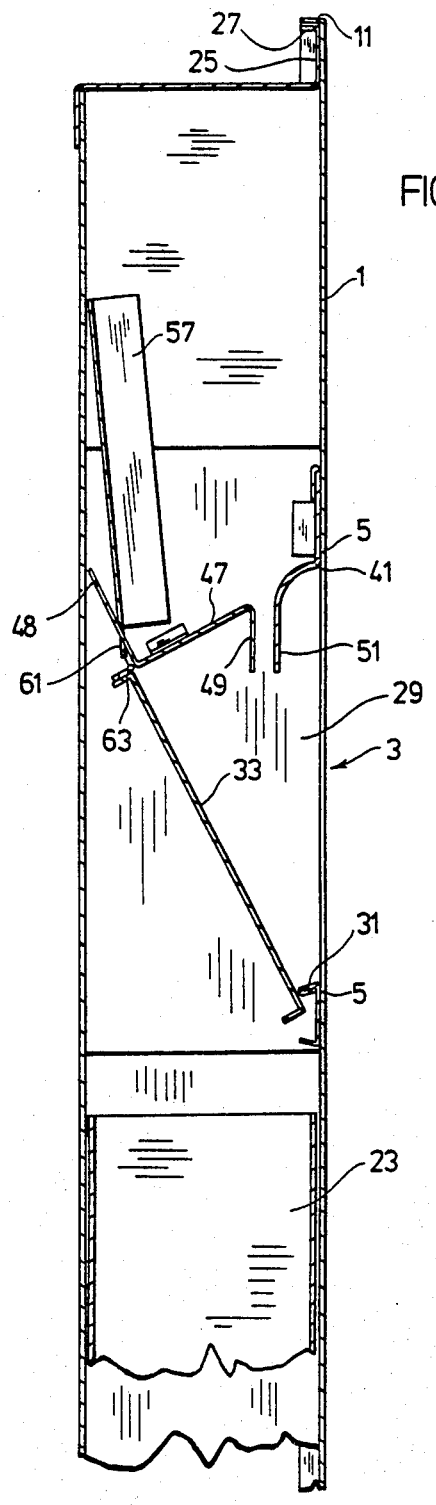
FIG. 6 is a side view of the towel dispensing region and upper part of the waste bin of the unit shown in FIGS. 1 and 4.

As is well shown in FIGS. 5 and 6, forward stop 41 as well as brace 31 across the wall box, are folded and flattened along their upper edges to eliminate the exposure of any burred edge regions where either the attendant or anyone using the unit, might otherwise cut their hands. As a further safety precaution, cradle housing 43 is rounded around the door flange so that when the door is closed and locked, as shown in FIG. 1, substantially all of the sharp or burred regions on the box, are covered by the door.

The corners on the box flange are reinforced by means of corner pieces 37 as shown in FIG. 2. These corner pieces, in addition to providing a neat and strengthened corner region, essentially eliminate all sharp edges at the corners of the wallbox where the attendant might otherwise again, by subject to unnecessary cutting of his or her hands.

The particular hinge unit 35 used for mounting the door to the wallbox is again, of a construction which enhances the strength of the hinge. The front portion 35*a* of the hinge is secured at the front of the box flange while the side portion 35B is secured to the rearward extension 27 of the box flange. The outer hinge portion 35*c* is secured to the inside of the door flange 11. When the door is closed, the hinge is sandwiched between the protected by both the door and the wall box so that it is not exposed to any unauthorized tampering.

When the door of the unit is open as shown in FIG. 4, the entire interior of the box is accessible to the attendant who can replace the towels and clean out the wastebin which is easily removed and replaced from the unit. As is well shown in FIG. 4, this wastebin substantially fills the entire lower part of the wallbox such that when it is in position within the box, the front of the bin is flush with the front of the wallbox. Accordingly, when the door of the unit is closed, as shown in FIG. 6, the door is well supported from its interior by means of the wastebin in the lower part of the unit which is sandwiched between the door and the backwall of the wallbox, the brace 31 of the towel cradle subassembly, which as mentioned above is flush to the front of the wallbox so that the door sits against the brace, the forward stop 41 and flange portions 45 of the towel cradle subassembly which are also flush to the door and the box flange 25 which mates with the outer peripheral region of the door.

In addition to being supported against inward collapsing as described above, the door is well shielded by the wall box so that very little leverage can be applied to the door for prying it away from the wall box.

In particular, the two areas that are readily accessible for prying, on a conventional unit, are the edge region of the door and the mouthwall surrounding the mouth opening to the towel dispensing cavity. However, according to the present invention, since the forward door is provided with the rearwardly extending flange 11 which wraps around the encases the box flange portion 27, the door flange 11 is almost totally inaccessible. This feature is augmented by the fact that the box is mounted in the wall as shown in FIG. 1 so that the unit is an integral part of the wall and is not accessible from its rear side to which flange 11 and flange portion 27 are directed. The integrating of the unit with the wall further contributes to the strength of the unit which derives support from the wall.

The doormouth is well protected as shown in FIG. 3. When the door is closed, its periphery or mouthwall 5 is essentially blocked along the side edges of the doormouth by means of cradle housing 45, along the top of the doormouth by means of stop 41 and along the bottom of the doormouth by means of brace 31. As described above, each of these components i.e., the cradle housing, the cradle forward stop and the lower brace of the cradle, all fit essentially flushly up against the door. However, in addition, each of these components projects inwardly into the doormouth beyond the mouthwall 5 thereby, effectively shielding the mouthwall and substantially eliminating accessibility for prying of the door away from the wallbox at the mouthwall.

According to the drawings, and the description above, cradle housing 45 is used to interiorly block the mouthwall. However, if the cradle housing is set up such that it does not wrap around the box flange i.e., only extends as far forward as housing portion 43, then the box flange itself, which also extends inwardly of the sides of the mouthwall, provides a shield against gaining access to the mouthwall sides. Furthermore, brace 31 need not be an integral part of the cradle subassembly, and can be added on its own to the unit.

As earlier mentioned, brace 31 is threefold in function. These functions which have been well described above, include providing an internal support against the inward collapsing of the door, providing an overlapping shield projecting the lower mouthwall of the doormouth against outward prying and providing a locking bar for engaging lock member 9. Further to this latter feature, brace 31 which due to its central positioning in the wallbox, and its consequent main locking action must be extremely resistant to outward bending. This feature is provided not only by the beefing up of the brace as shown in the drawings but also by the extension of the brace completely across the wallbox so that both of the brace ends are secured to the cradle to resist outward bending of the brace.

Figure 7:
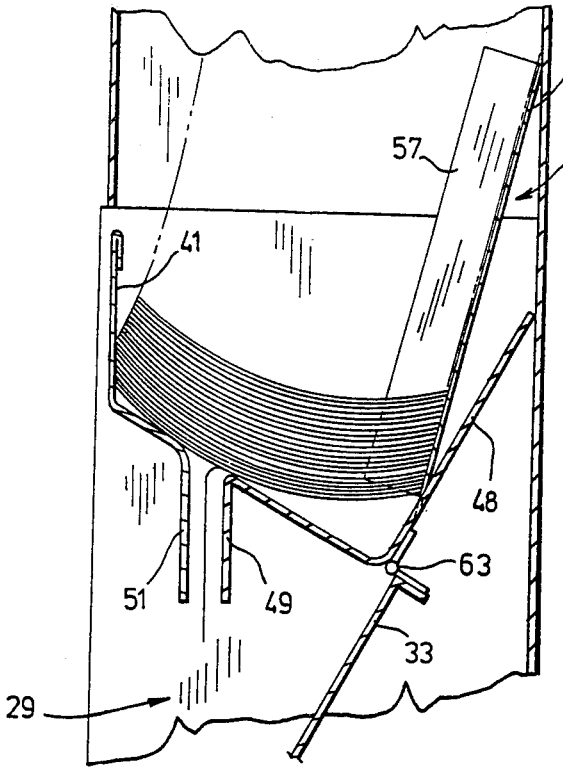
FIGS. 7 and 8 are side views of the wallbox in the cradle region showing the dispensing of the folded towels shown in FIGS. 1*b* and 1*c*, from the wallbox.
Figure 8:
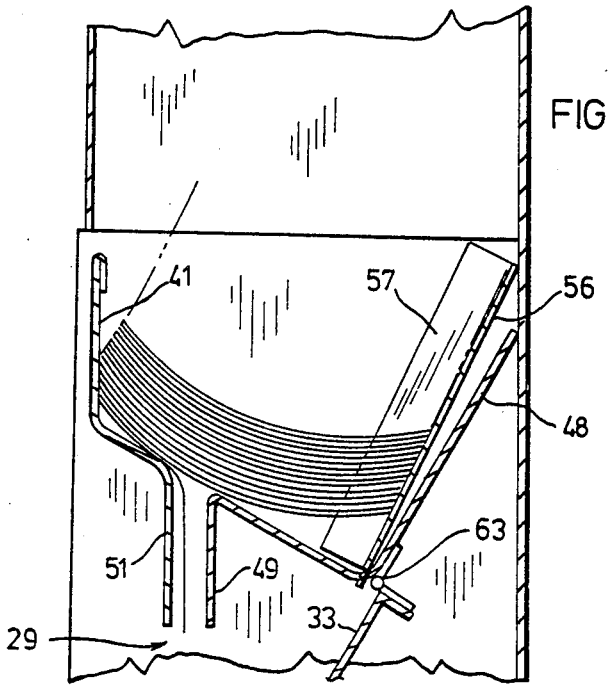
Figure 9:
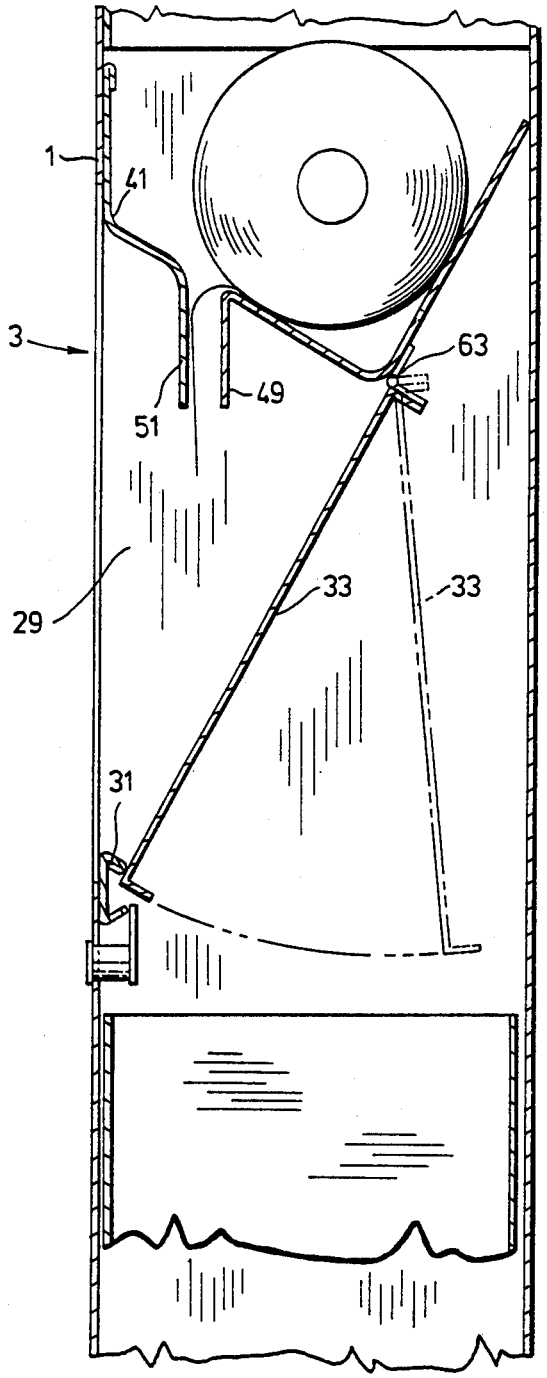
FIG. 9 is a side view of the wall box and door in the cradle region showing the dispensing of towels from the roll shown in FIG. 1*a*.

The universal dispensing of the different types of towels of FIGS. 1*a* through 1*c* is shown in FIGS. 7 through 9. The multi-fold towel bundle which is shown in FIG. 1*b* is relatively narrow in which case, adapter 55 is used in the dispensing of the towels. The adapter as shown in FIG. 7 is fitted in the towel cradle with prongs 61 being fitted into receiving apertures 53. The narrow towel bundle is then pushed up against the front stop 41 by the adapter with rails 57 providing a side guide for the towels. The adapter therefore, acts as a spacer to push the towels forwardly of the cradle into the proper dispensing position shown in FIG. 7.

The single fold towel bundle of FIG. 1*c* is relatively wide and adapter 55 is not required to properly position this towel bundle in the dispensing position. The adapter can either by simply laid up against the backstop 48 as shown in FIG. 8 or it can be completely removed from the towel cradle as is shown in FIG. 9, where again, the adapter is not required for the dispensing of a towel from a roll. It will be seen in FIG. 9 that throat portions 51 and 49 provide an extremely effective cutting edge for ripping of the towel from the roll. Furthermore, throat portion 51 is provided with an opening 52 for grasping of the towel which is hidden behind the forward throat portion. Opening 52 also provides a viewing window to see when the towel cradle has been emptied.

Figure 12:
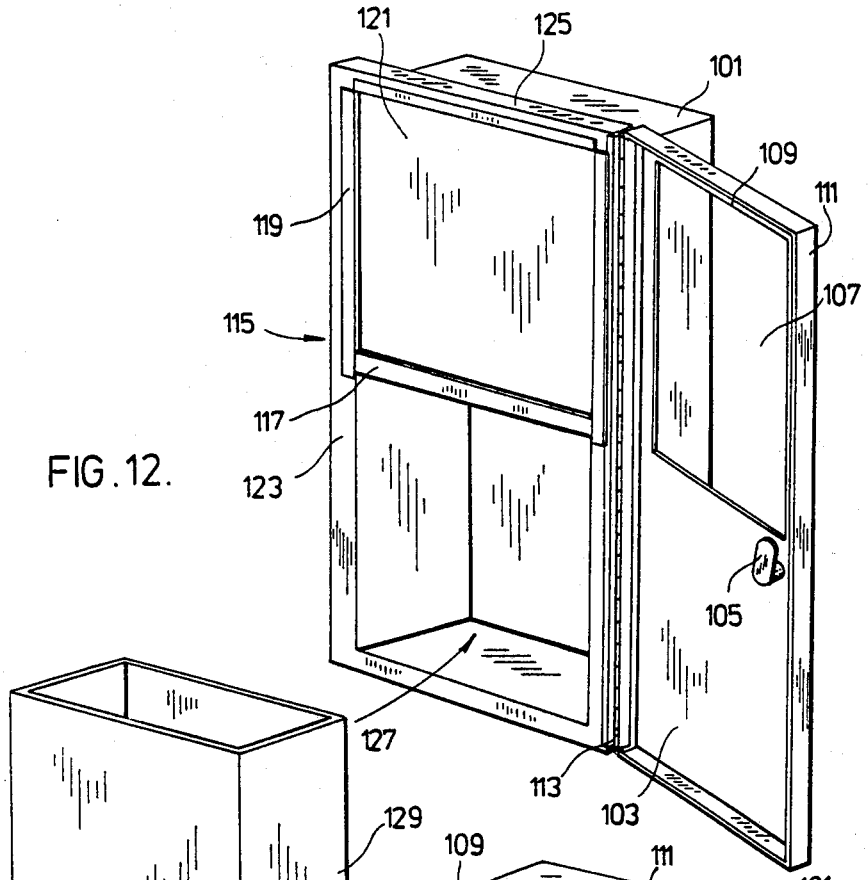
FIGS. 12 and 13 are front perspective views open and closed respectively, of a waste receptacle according to a preferred embodiment of the present invention.
Figure 13:
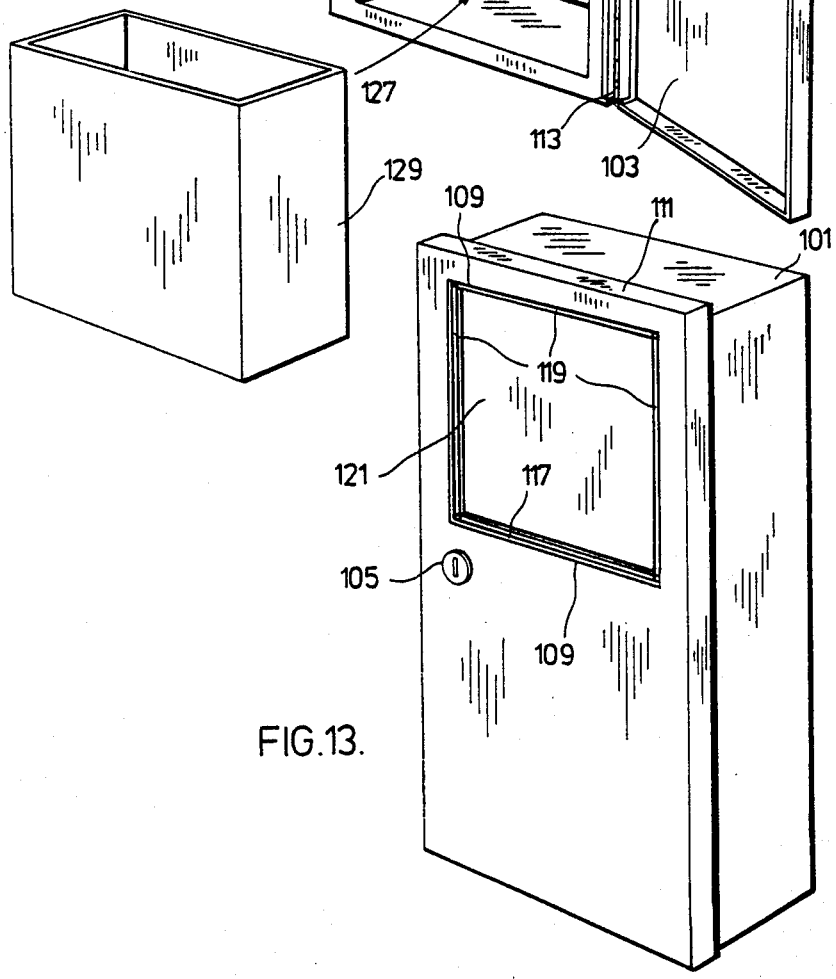

The towel dispenser of FIGS. 10 and 11 as well as the waste receptacle of FIGS. 12 and 13, embody the same principles and features as those found in the combination unit, shown in FIGS. 1 through 9.

Having particular reference to FIGS. 10 and 11, the towel dispensing unit comprises a box portion 71 and a door 73, connected by hinge 83, to the box portion. The hinge is again, sandwiched between the box flange 85 and the door skirt 75 where, when the unit is mounted recessed in the wall, the hinge is almost totally inaccessible.

Door 73 is provided with an opening 77 which when the door is closed, opens into the towel dispensing cavity 88 of the wall box. The door is further provided witha locking member 81 which when the door is locked, is engaged by hook 99 of the wall box.

The towel cradle assembly generally indicated at 87 in the wall box, comprises housing portion 89, presenting outwardly extending flange portions 91 wrapping around the box flange 85 as well as a forward towel stop 93, providing a brace across the front of the wall box. Forward stop 93 curves downwardly and inwardly to a forward throat portion 95, provided with a finger axis and viewing window 97. Adapter 55 which makes the towel cradle universal for multi-fold, single fold and rolled towel, is identical to the adapter described above.

When the door of the box is closed as shown in FIG. 11, door skirt 75 wraps around and encases, the rearwardly extending portion 86 of box flange 85 and because the wall box is again, mounted to or recessed in a wall, depending upon the particular installation used, the back of the box is essentially hidden and there is very little space between the door skirt and the wall with the skirt being shielded by, the box flange so that the skirt is essentially hidden from prying.

As was the case with the combination unit, door 73 of the towel dispenser is well supported against inward collapsing by the towel cradle assembly brace 93 as well as box flange 85, both of which are essentially flush to the door when it is closed. Furthermore, brace 93 and housing flange portions 91 which extend slightly inwardly relative to the periphery 79 of the door opening, block off access to the opening periphery along the side and top edges of the opening. The box flange itself, projects slightly upward beyond the opening periphery at the bottom of the opening as is well shown in FIG. 11, to complete the shielding action around the door opening.

The waste receptacle shown in FIGS. 12 and 13 comprises a wall box 101 and a door 103 connected to the wall box by means of hinge 113. The door is provided with a mouth or opening 107, a locking member 105, located approximately centrally of the door and a door skirt 111.

Wall box 101 is again, provided with an internal subassembly which as was the case in the earlier arrangements, substantially strengthens the wall box. However, unlike the earlier arrangements, sub-assembly 115 is a door assembly rather than a towel cradle assembly. Still, this door assembly performs substantially the same functions as the earlier described towel cradle assemblies.

More specifically, the door subassembly 115 comprises an integrating housing secured to the interior of the wall box and presenting outwardly extending flanges 119 wrapping around the box flange 123. The remainder of the housing is hidden by means of door 121, spring biased to the closed position of FIGS. 12 and 13. The door subassembly further includes structural support or brace 117 extending completely across the wall box at approximately its midpoint.

The wall box is further provided with a lower waste bin receiving region 127 adapted to receive waste bin 129. This waste bin when inserted in the wall box also adds to its strutural strength.

When the door is closed, as shown in FIG. 13, door skirt 111 wraps around and encases, box flange 123 and its rearwardly extending flange portions 125, thereby, shielding the door skirt against outward prying around the edge of the door.

The door is supported from its inside against inward collapsing by means of the box flange as well as brace 117 and waste bin 129 which sit substantially flushly against the inside of the door. The door is therefore, well supported to prevent damage through caving in of the door into the wall box.

The periphery 109 of doormouth 107 is shielded along its side and top edges by means of housing flange 119 and along its bottom edge by means of supporting brace 117. This in combination with the protection provided around the door skirt, substantially eliminate the possibility of outward prying of the door.

Consistent with the combination unit, lock 105 hooks onto and engages, brace 117 when the door is locked to the wall box. This brace again, provides an extremely effective securing member for the lock through both its central positioning in the box for equal force distribution over the box and its extension completely across the box where, by means of the door assembly housing, it is integrated with the box sides.

Door 121 of the waste receptacle, which as mentioned above, is spring biased to the closed position, substantially eliminates the possibility of fire danger from the box. If for some reason or other, a fire is started in the waste bin, the door does not permit the fire to escape and will choke the fire off.

As has been well described above, each of the preferred units shown in the drawings, including the independent towel dispenser and waste receptacle as well as the combination unit, are provided with reinforcing inserts which are multifold in function. These inserts not only strengthen the box but additionally, protect the door against both inward collapsing and outward prying. These features as well as the fact, that the wall box is generally mounted such that it forms an integral part of the wall, provide a unit which is extremely resistant to tampering, which is particularly important in view of the fact that these units are generally located in public washrooms, where they are usually subject to substantial damage.

Although various preferred embodiments of the invention have been described herein in detail, it will be apparent to one skilled in the art that variations may be made thereto, without departing from the spirit of the invention or the scope of the appended claims.

The embodiments of the invention in which an exclusive property or privilege is claimed are defined as follows:

1. A tamper resistant towel dispenser and waste unit for mounting to a wall and comprising a wall box and a forward door for opening and closing the wall box, said wall box being provided with a towel cradle assembly, a towel dispensing cavity in the towel cradle assembly, a waste bin receiving region for receiving a waste bin which substantially fills the waste bin receiving region when inserted in the wall box, and an outwardly projecting box flange around the wall box; said door having a mouth which opens into the towel dispensing cavity in the wall box when the door is closed, an outer peripheral region adapted for mating with the box flange around the wall box and locking means for locking the door closed, the arrangement being such that when the waste bin is received within the wall box with the door closed, the waste bin which is sandwiched by the door in the wall box and the box flange and, the towel cradle assembly, support the door against the inward collapsing, and such that the box flange underlies the outer peripheral region of the door and the towel cradle assembly shields the door mouth at its periphery to substantially reduce leverage for outward prying of the door away from the wall box.

2. A towel dispenser and waste unit as claimed in claim 1, wherein said box flange includes a rearwardly projecting skirt and said outer peripheral region of said door is provided with a rearwardly projecting the flange which wraps around and encases the box flange skirt.

3. A towel dispenser and waste unit as claimed in claim 2, wherein said door is provided with an upper lock above the door mouth and a lower lock below the door mouth and includes a hook member for catching said upper lock with said towel cradle assembly being positioned to catch said lower lock.

4. A tamper resistant towel dispenser and waste unit for mounting recessed in a wall and comprising a wall box and a covering door for opening and closing the wall box, said wall box being provided with a towel cradle assembly comprising a housing portion, presenting upper and lower braces across the box at its front side, a towel dispensing cavity above and rearwardly of the lower brace of the towel cradle assembly and bordered by said housing portion, a waste region for receiving a waste bin which, when inserted in the wall box substantially fills the waste region and a box flange which projects outwardly to a rearwardly projecting flange portion, said housing portion of said cradle assembly being secured to said box flange, said door having an access opening which opens into the towel dispensing cavity when the door is closed and which has a mouthwall which aligns along its top edge with the upper brace of the cradle assembly, along its bottom edge with the lower brace and along its side edges with the housing portion of the cradle assembly, said door further including an upper and a lower locking member, and an outer peripheral region having a rearwardly projecting skirt for encasing said box flange; the arrangement being such that when the waste bin is inserted in the wall box, and when the door is closed, the waste bin, the box flange, and the housing and braces of the cradle assembly are essentially flush to the door and support the door against inward collapsing and the towel cradle assembly blocks off the door opening mouthwall with the rearwardly projecting flange portion of the box flange shielding the skirt on the door for substantially eliminating leverage for outward prying of the door.

5. A towel dispenser and waste unit as claimed in claim 4 including a spring mounted door which is normally biased to a closed position for closing said waste region.

6. A towel dispenser and waste unit as claimed in claim 4 wherein said upper brace of said towel cradle assembly extends downwardly and inwardly to a throat portion past which towels are dispensed.

7. A towel dispenser and waste unit as claimed in claim 4 including a reinforced hinge interconnecting said door and said wall box, said hinge being inaccessibly sandwiched between the door skirt and the box flange.

8. A towel dispenser and waste unit as claimed in claim 4 wherein said box flange is provided with rearwardly secured corner reinforcing members for strengthening the box flange.

9. A towel dispenser and waste unit as claimed in claim 4 wherein said lower brace of said cradle assembly is located approximately centrally of the wall box and is reinforced to receive said lower locking member.

10. A towel dispenser and waste unit as claimed in claim 4 including an adapter for adapting said towel cradle to receive different types of towel supplies including wide and thin towel bundles and towel rolls.

* * * * *